US006419520B2

(12) United States Patent
Miersch et al.

(10) Patent No.: US 6,419,520 B2
(45) Date of Patent: Jul. 16, 2002

(54) CABLE CONFIGURATION

(75) Inventors: Erik Miersch, Wiensenbronn; Markus Bee, Gerbrunn; Martin Glösslein, Theilheim, all of (DE)

(73) Assignee: Leoni Bordnetz-Systeme GmbH & Co KG, Nuremberg (DE)

( * ) Notice: Subject to any disclaimer, the term of this patent is extended or adjusted under 35 U.S.C. 154(b) by 0 days.

(21) Appl. No.: 09/741,224

(22) Filed: Dec. 18, 2000

(30) Foreign Application Priority Data

Dec. 18, 1999 (DE) ..... 199 61 238

(51) Int. Cl.[7] ..... H01R 13/58
(52) U.S. Cl. ..... 439/452; 439/455
(58) Field of Search ..... 174/70 R, 73.1, 174/74 R; 439/452, 453, 455

(56) References Cited

U.S. PATENT DOCUMENTS 3,588,039 A * 6/1971 Chelminski
3,668,610 A * 6/1972 Flanagan

FOREIGN PATENT DOCUMENTS

DE 38 31 175 A1 3/1990

* cited by examiner

*Primary Examiner*—Khiem Nguyen
(74) *Attorney, Agent, or Firm*—Laurence A. Greenberg; Werner H. Stemer; Gregory L. Mayback

(57) ABSTRACT

An electric cable has a cable jacket, a plastic part molded onto the cable jacket in an end region of the cable, a plurality of cores and a strain relieving thread for increasing the tensile strength of the cable. The strain relieving thread emerges from the cable jacket and is integrally and/or interlockingly embedded in the plastic part.

16 Claims, 1 Drawing Sheet

CABLE CONFIGURATION

BACKGROUND OF THE INVENTION

Field of the Invention

The invention relates to a cable with line elements, and in particular to an electric cable with a plurality of cores sheathed by a cable jacket.

In order to increase the tensile strength of a cable, it is known to insert into such cables a strain relieving thread, which is for example formed from "KEVLAR" filaments. In the case of electric cables for example, a maximum elongation of 2% is required. In the case of conventional cables, the strain relieving thread does not, however, contribute to the strength of the connection of a cable end, for instance to a plug or a socket. It is, however, precisely the connection between the cable end and a connecting element, such as a plug or a socket, that causes most problems in practice.

SUMMARY OF THE INVENTION

It is accordingly an object of the invention to provide a cable configuration which overcomes the above-mentioned disadvantages of the heretofore-known cable configurations of this general type and in which the strength of the connection between the cable end and a plastic molding molded onto the cable end is increased.

With the foregoing and other objects in view there is provided, in accordance with the invention, a cable configuration, including:

a cable having an end region, the cable including a plurality of cores, a cable jacket, and a strain relieving thread for increasing a tensile strength of the cable;

a plastic part formed onto the cable jacket at the end region; and the strain relieving thread emerging from the cable jacket and being integrally and/or interlockingly embedded in the plastic part.

In other words, the object of the invention is achieved in that the strain relieving thread is led out of the cable jacket and is embedded integrally and/or in an interlocking or formlocking manner in the material of the plastic part. A tensile force acting on the cable is consequently introduced into the plastic part , for instance a plug, via the strain relieving thread. In this way, the electrical connections within a plug are protected against the action of tensile forces.

The plastic part may be configured as a rear-engaging part which can be placed with interlocking engagement in the longitudinal direction of the cable into a recess of an electrical device or a component to which a cable end is to be connected. Here, too, pulling on the cable has virtually no effect on the electrical connection of the cores of the cable to the electrical device, but instead is absorbed by the strain relieving thread of the cable.

Furthermore, there is the possibility of the strain relieving thread, which is led out from the cable jacket, being embedded in a plastic part which, together with the regions of the cable jacket adjoining it on both sides, is encapsulated by a plug part or the like. The plastic part may in this case be of a harder material, securely enclosing the strain relieving thread within it, while the housing of the electrical connecting element, that is of a plug or a socket or the like, may be formed of a softer, flexible material. With a suitable choice of material, however, the plastic part accommodating the strain relieving thread may, however, also itself be a housing or an electrical connecting part, that is a plug or a socket.

According to another feature of the invention, the housing, the plug, the socket, and/or the plastic part may be formed by injection molding or casting.

Other features which are considered as characteristic for the invention are set forth in the appended claims.

Although the invention is illustrated and described herein as embodied in a cable configuration, in particular an electric cable configuration, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

SUMMARY OF THE INVENTION

Figure 1:
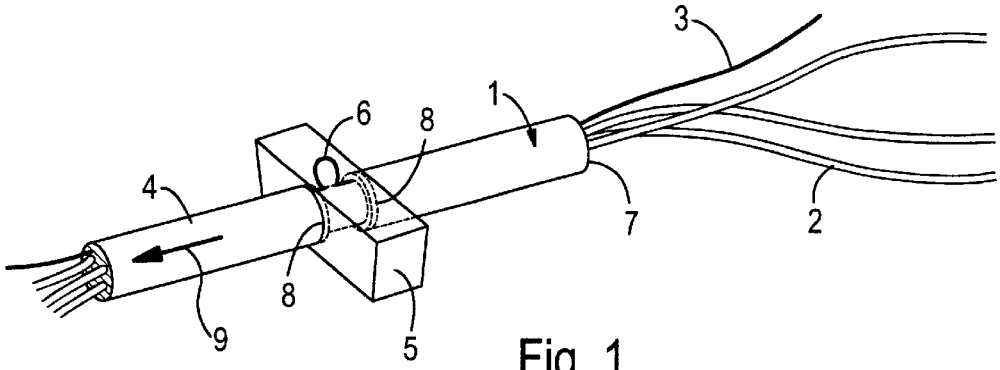
FIG. 1 is a perspective view of a cable end with a molded-on plastic part.

Referring now to the figures of the drawings in detail and first, particularly, to FIG. 1 thereof, there is shown the end 1 of an electric cable, which includes a plurality of cores 2, a strain relieving thread 3, for example formed of "KEVLAR", and a cable jacket 4. This cable serves for a fixed connection to an electrical component or an electrical device. For this purpose, the stripped core ends are electrically and mechanically connected to contact parts of the electrical device or component. For relieving these contact points, an approximately cuboidal or prism-shaped plastic part 5, in which a loop 6 of the strain relieving thread 3 is embedded, is molded or formed onto the cable end. In the present case, the cable jacket 4 is stripped at an axial distance from its extreme end 7, so that an annular, stripped cable region is produced. From this region, the "KEVLAR" thread is drawn out, forming a loop 6. Subsequently, the cable end prepared in this way is placed into an injection mold or casting mold and encapsulated with the plastic part 5 by injection molding or casting. The plastic part is in this case dimensioned in such a way that it also embeds the regions 8 of the cable jacket 4 flanking the stripped cable region. The plastic part is placed into a recess of an electrical device or component with interlocking engagement effective in the longitudinal direction of the cable. A dashed line 12 in FIG. 1 schematically indicates the recess of the electrical device or component. A force acting in the direction of the arrow 9, that is in the longitudinal direction of the cable, is transferred primarily via the strain relieving thread 3, or via the loop 6, to the plastic part 5 and consequently to the housing of the electrical component or device. In this way, the core ends are effectively relieved. PVC (polyvinyl chloride) and PU (polyurethane) may for example be used as materials for the cable jacket and PA (polyamide) may for example be used for the plastic part. However, other combinations of plastics may be used.

Figure 2:
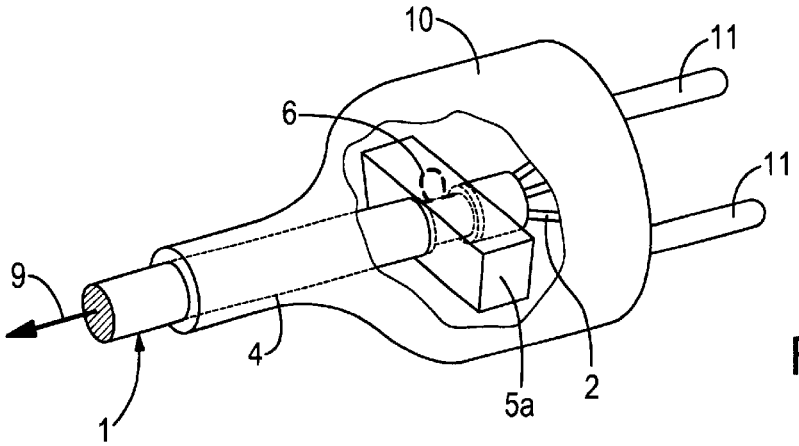
FIG. 2 is a perspective, partly broken away view of the cable end according to FIG. 1, which has been additionally encapsulated in a plug housing.

In the case of the exemplary embodiment according to FIG. 2, the plastic part Sa does not serve as a rear-engaging part interacting with an electrical component or an electrical device, but instead it is encapsulated—together with the cable jacket regions extending away from it on both sides—in a plug housing 10. The connecting parts of the cores 2 with the plug contact pins 11 are effectively relieved when there is axial loading in the direction of the arrow 9, since the tensile forces are introduced into the plug housing 10 via the thread loop 6 and the plastic part 5*a*. A configuration according to FIG. 2 is appropriate, for example, if the material used for the plug 10 does not provide a suitable or appropriate integral bond with the loop 6.

Figure 3:
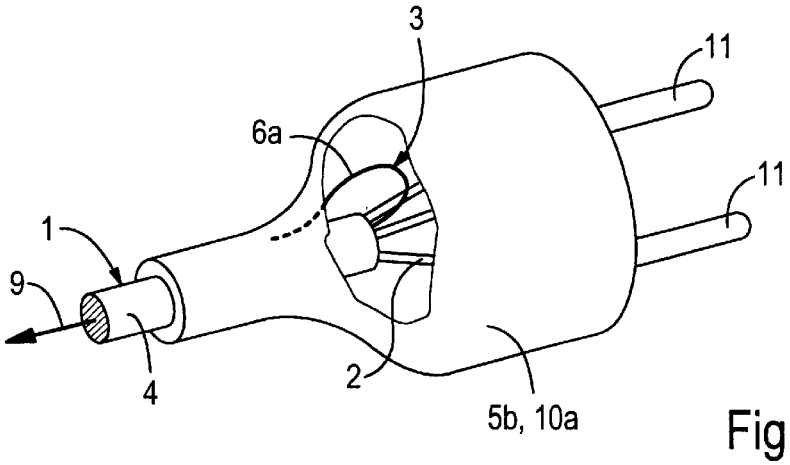
FIG. 3 is a perspective, partly broken away view of a cable end wherein the molded-on plastic part is a plug.

In the case of the exemplary embodiment according to FIG. 3, the plastic part 5*b* is formed by a plug housing 10*a*. An annular stripping of the cable jacket as in the case of the examples according to FIGS. 1 and 2 is not required here. Here, the end of the strain relieving thread 3 protruding from the extreme end 7 of the cable is bent back, likewise forming a loop 6*a*, and is fixed to the outer circumference of the cable jacket. The cores are connected to corresponding contact parts, for example to plug pins 11, and the cable end prepared in this way is enclosed by the plug housing 10*a* in a casting mold or injection mold.

We claim:

1. A cable configuration, comprising:

a cable having an end region, said cable including a plurality of cores, a cable jacket, and a strain relieving thread for increasing a tensile strength of said cable;

a plastic part formed onto said cable jacket at said end region; and said strain relieving thread emerging from said cable jacket; and said plastic part being one of injection molded and cast around said strain relieving thread causing said strain relieving thread to be integrally embedded in said plastic part.

2. The cable configuration according to claim 1, including:

a component electrically connected to said cable at said end region, said component being formed with a recess;

said cable defining a longitudinal direction; and said plastic part being formed as a rear-engaging part insertable into said recess with interlocking engagement effective in the longitudinal direction.

3. The cable configuration according to claim 1, including:

an electrical device electrically connected to said cable at said end region, said electrical device being formed with a recess;

said cable defining a longitudinal direction; and said plastic part being formed as a rear-engaging part insertable into said recess with interlocking engagement effective in the longitudinal direction.

4. The cable configuration according to claim 1, wherein:

said plastic part has two opposing sides, said cable jacket has regions adjoining said plastic part at said two opposing sides; and a housing embedding said plastic part and said regions of said cable jacket adjoining said plastic part.

5. The cable according to claim 4, wherein said housing is an electrical connecting element housing.

6. The cable configuration according to claim 4, wherein said housing is a plug housing.

7. The cable configuration according to claim 4, wherein said housing is a socket housing.

8. The cable according to claim 4, wherein said housing is an injection-molded housing molded around said plastic part.

9. The cable configuration according to claim 4, wherein said housing is a cast housing cast around said plastic part.

10. The cable configuration according to claim 1, wherein said cable is an electrical cable.

11. The cable configuration according to claim 1, wherein said plastic part is a housing.

12. The cable configuration according to claim 11, wherein said plastic part is an electrical connecting element housing.

13. The cable configuration according to claim 11, wherein said plastic part is a plug housing.

14. The cable configuration according to claim 11, wherein said plastic part is a socket housing.

15. The cable configuration according to claim 11, wherein said plastic part is an injection-molded housing.

16. The cable configuration according to claim 11, wherein said plastic part is a cast housing.

* * * * *